US006343959B2

(12) United States Patent
Sato

(10) Patent No.: US 6,343,959 B2
(45) Date of Patent: Feb. 5, 2002

(54) CONNECTOR ASSEMBLY

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/796,601

(22) Filed: Mar. 2, 2001

(30) Foreign Application Priority Data

Mar. 3, 2000 (JP) ..... P 12-059059

(51) Int. Cl.[7] ..... H01R 13/502
(52) U.S. Cl. ..... 439/701
(58) Field of Search ..... 439/701, 717, 439/731, 598, 599, 594, 357

(56) References Cited

U.S. PATENT DOCUMENTS 5,288,251 A * 2/1994 Sumida ..... 439/701

* cited by examiner

*Primary Examiner*—Brian Sircus
*Assistant Examiner*—Phuong Dinh
(74) *Attorney, Agent, or Firm*—Finnegan, Henderson, Farabow, Garrett & Dunner, L.L.P.

(57) ABSTRACT

Connector housings are stacked vertically in multi-steps. The connector housings include lock claws at both of side parts thereof. The lock claws of the connector housings engage with the lock claws of another connector housings by flexure deformation of mounting parts of the lock claws for integration of the connector housings. The connector housings have protrusions and recessed parts at the mounting parts thereof. The protrusions of the connector housings are fitted with the recessed parts of another connector housings. The mounting parts are prevented from deformation.

5 Claims, 4 Drawing Sheets

CONNECTOR ASSEMBLY

BACKGROUND OF THE INVENTION

The present invention relates to a connector assembly which is integrated such that connector housings are stacked vertically in multi-steps for integration.

A connector assembly is integrated that identically configured connector housings are stacked vertically in two steps.

Upper and lower connector housings respectively have lock claws at both of right and left side parts thereof. The housings have outer lock claws at upper faces thereof, the outer lock claws projecting inward from inner walls of engagement stepped parts. The housings have inner lock claws at lower faces thereof, the inner lock claws projecting outward from outer walls of engagement stepped parts.

The outer lock claws at the upper faces and the inner lock claws at the lower faces are engaged each other such a way that the stepped parts engage together each other when stacking the housings, with the outer lock claws positioned outward and the inner lock claws positioned inward. Mounting parts of the lock claws are flexure deformed such that the outer lock claws are fell down outward, the lock claws are engaged or disengaged each other.

SUMMARY OF THE INVENTION

In the connector assembly, wires are drawn out from rear ends of the connectors. If a force is applied to the wires to be vertically pulled or a force is exerted on the upper and lower housings to be separated each other, flexure deforming the mounting parts outward causes engagements of the stepped parts of the lock claws to be reduced, and locking is easy to be detached, so that integration force of the connector assembly is weakened.

An object of the present invention is to provide a connector assembly in which locking is not easy to be detached, once connectors are integrated and locked.

To achieve the object, a first aspect of the invention provides the following connector assembly. Connector housings are stacked vertically in multi-steps. The connector housings include lock claws at both of side parts thereof. The lock claws of the connector housings engage with the lock claws of another connector housings by flexure deformation of mounting parts of the lock claws for integration of the connector housings. The connector housings have protrusions and recessed parts at the mounting parts thereof. The protrusions of the connector housings are fitted with the recessed parts of another connector housings. The mounting parts are prevented from deformation.

Preferably, each of the connector housings includes: a first lock claw at one side thereof and a second claw at another side thereof configured to engage each other; and a protrusion at the one side and a recessed part at another side configured to fit each other.

A second aspect of the invention provides the following connector assembly. Connectors are stacked each other. The connectors include the housings including first engagement parts and second engagement parts. The first engagement parts of the housings are locked with the second engagement parts of another housings. The first engagement parts include protrusions and recessed parts. The protrusions of the housings are fitted in the recessed parts of another housings.

According to the aspects, if separating force is applied between the connector housings integrally joined, the mounting parts are apt to be flexed in a direction where the engagements of the lock claws. In the connector assembly, the protrusions of the housings are fitted in the recessed parts of another housings, and the lock claws are not easy to be disengaged.

At the one side and another side of each of the connector housings, the first lock claw and the second lock claw configured to engage each other and the protrusion and the recessed part configured to fit each other are provided. Thus, the connector housings are stacked in more than two steps, and the lock claws are difficult to be disengaged.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
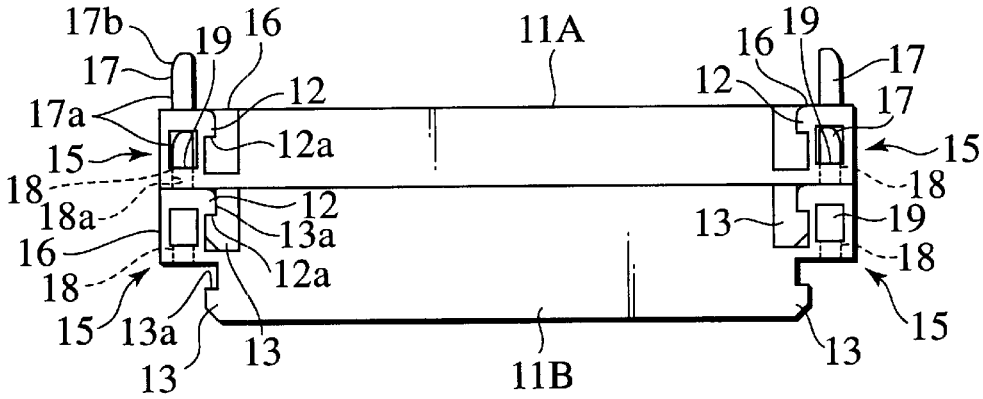
FIG. 1A shows a normal assembly state.
Figure 1B:
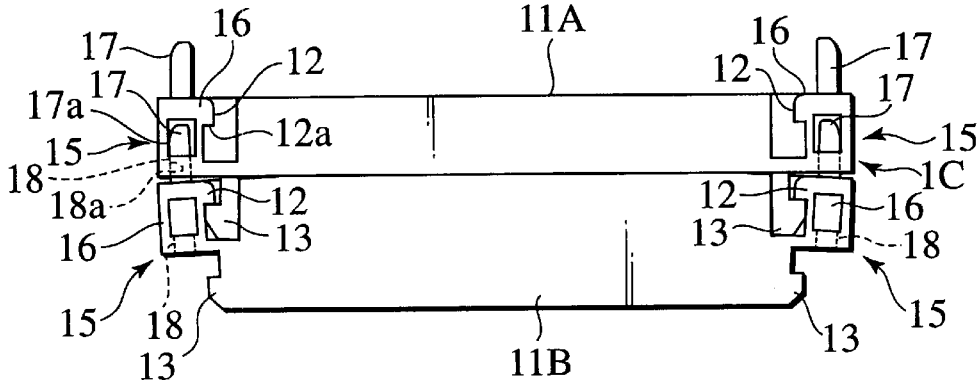
FIG. 1B shows upper and lower connector housings to which separating force is applied.

There will be detailed below the preferred embodiments of the present invention with reference to the accompanying drawings.

A connector assembly is composed such that an upper connector housing 11A and a lower connector housing 11B are stacked and integrated each other.

The upper and lower housings 11A and 11B have lock claws 12 at upper faces and lock claws 13 at lower faces in both left and right side parts thereof. The housings 11A and 11B have outer lock claws 12 at upper sides thereof, the claws 12 being composed such, that stepped parts 12*a* of inner walls in recessed parts project inward. The housings 11A and 11B have inner lock claws 13 at lower faces thereof, the claws 13 being composed such that stepped parts 13*a* of outer walls of the housing 11A, 11B project outward.

When the housings 11A, 11B are stacked, with the outer claws 12 positioned outward and the inner claws 13 positioned inward, the stepped parts 12*a*, 13*a* are engaged each other, and the outer claws 12 and inner claws 13 lock each other. When the claws 12, 13 are to engage or to disengage each other, parts which are formed of outer claws 12 in mounting parts 15 of the claws 12, 13 are mainly to be flexure deformed outward.

Wholly to out sides of the flexure deformable claws 12, box parts 16 with peeps 19 at rear ends are provided. To upper faces of box parts 16, fit protrusions 17 in a rectangular section are provided. To lower faces of them, fit recessed parts 18 are provided. When the upper and lower housings 11A, 11B are stacked, a protrusion 17 of the lower housing 11B is fitted in a recessed part 18 of the upper housing 11A, so that a part formed of an outer claw 12 is restricted to flexure deform outward.

Figure 1C:
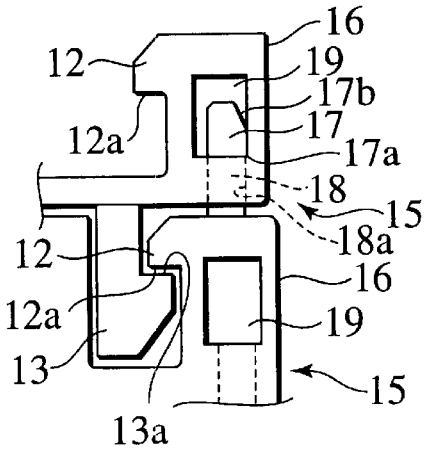
FIG. 1C is an enlarged view of a part designated by arrow 1C on FIG. 1B.

Specially, as shown on FIG. 1C, an outer face 17*a* of the protrusion 17 and an inner face 18*a* of the recessed part 18 are brought in contact with each other, and the part formed of the outer claw 12 is restricted to flexure deform outward. Initial clearance between both of the side faces 17*a,* 18*a* need to be appropriately set in accordance with an amount for restriction of a flexure deformation. Without the clearance, if fitting is too tight, the flexure deformation is not allowed at all, and engagement of the claws 12, 13 can be further difficult.

The protrusions 17 have inclined faces 17*b* to facilitate insertion to the recessed parts 18 at outer side faces of ends thereof.

Next, functions are explained.

In assembly of the connector assembly on Figs., the upper and lower housings 11A, 11B are stacked and the upper and lower claws 12, 13 are engaged each other for locking. At this time, the part formed of the outer claw 12 is mainly flexure deformed outward, and engagement together with the stepped parts 12*a,* 13*a* of the claws 12, 13 is performed.

At the same time, the protrusion 17 of the lower housing 11B is fitted in the recessed part 18 of the upper housing 11A. Thus, the part formed of the outer claw 12 is difficult to flexure deform outward. That is, fitting the protrusion 17 in the recessed part 18 causes the part formed of the outer claw 12 to gain flexure strength.

If vertically pulling force is exerted vertically on wires drawn out from rear ends of the housings 11A, 11B, or separating force is exerted between the rear ends of the upper and lower housings 11A, 11B integrally joined, engagement of the claws 12, 13 is difficult to be detached.

Specially explaining the point, referring to FIG. 1C, if the separating force is exerted between the upper and lower housings 11A, 11B, due to separating the engagement of the claws 12, 13, a box part 16 is apt to be flexed. However, the outer face 17*a* of the protrusion 17 is brought in contact with the inner face 18*a* of the recessed part 18, and restriction force not to further flex is applied. The part formed of the outer claw 12 is difficult to flex, and the engagement of the claws 12, 13 is not easy to be detached. Thus, the integration force of the upper and lower housings 11A, 11B is enhanced.

In the above-described embodiment, the connector assembly has housings stacked in two steps. The housing of the identical type is stacked on the upper housing 11A, and a connector assembly in more than three steps is configured. Between respective steps, protrusions 17 and recessed parts 18 are fitted at the same time of engagement with the claws 12, 13. Thus, parts formed of the outer claws 12 are difficult to flex, and locking is difficult to be detached.

Figure 5:
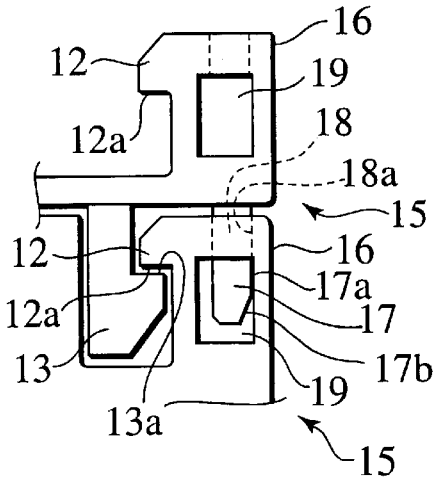
FIG. 5 is an enlarged view showing another embodiment.
Figure 2:
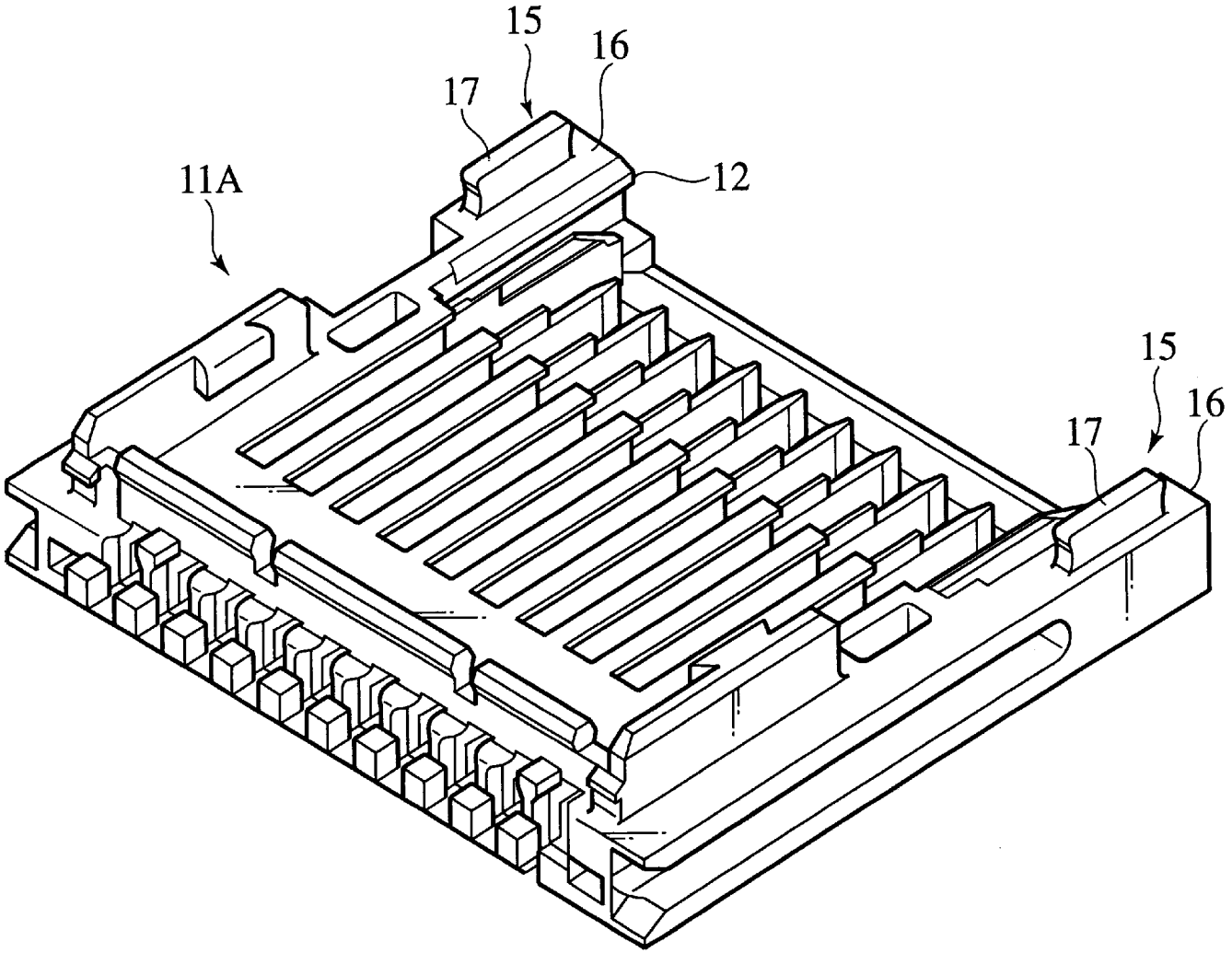
FIG. 2 is a perspective view of an upper connector housing on FIG. 1, viewed from above.
Figure 3:
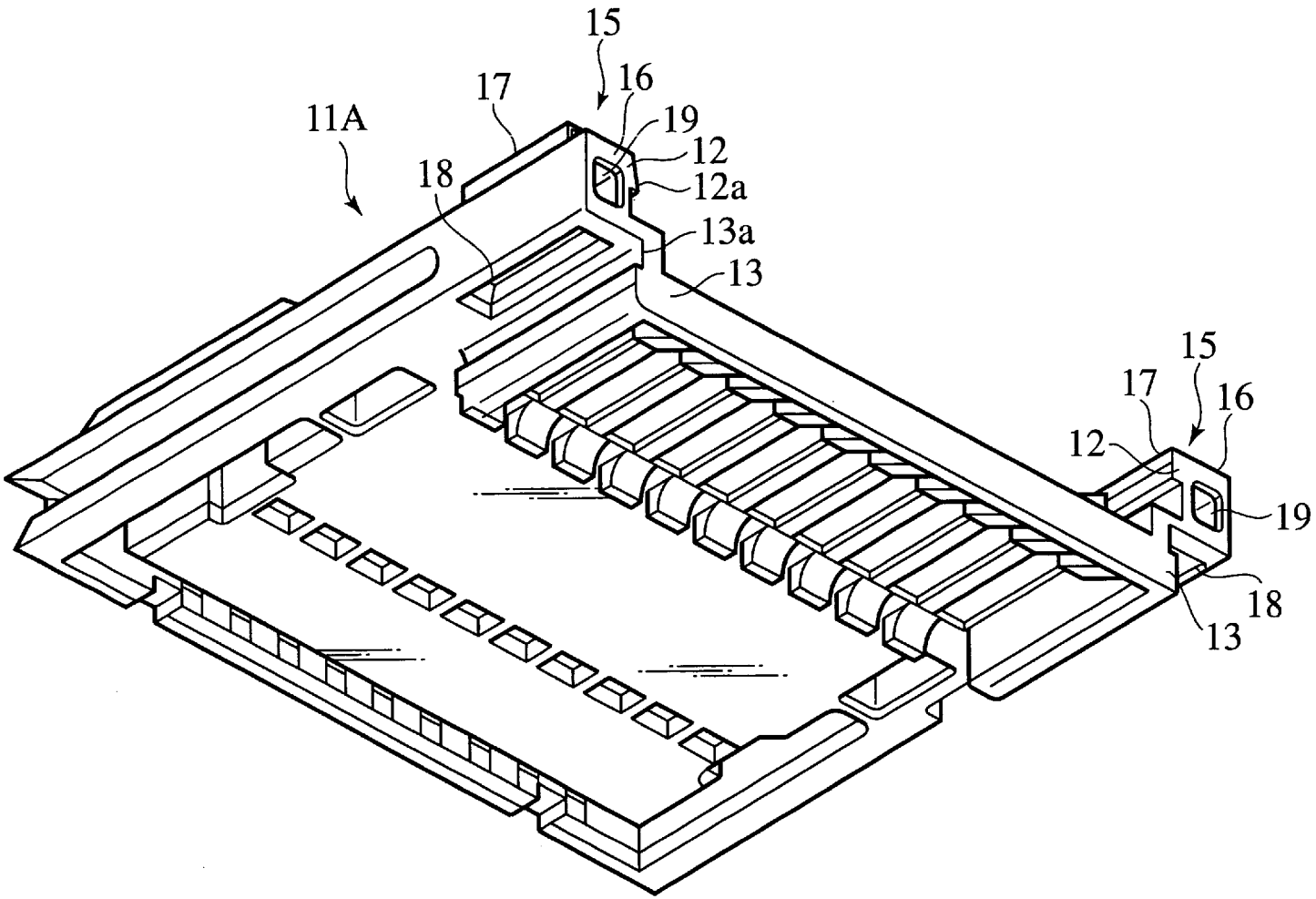
FIG. 3 is a perspective view of the connector on FIG. 2, viewed from below.
Figure 4:
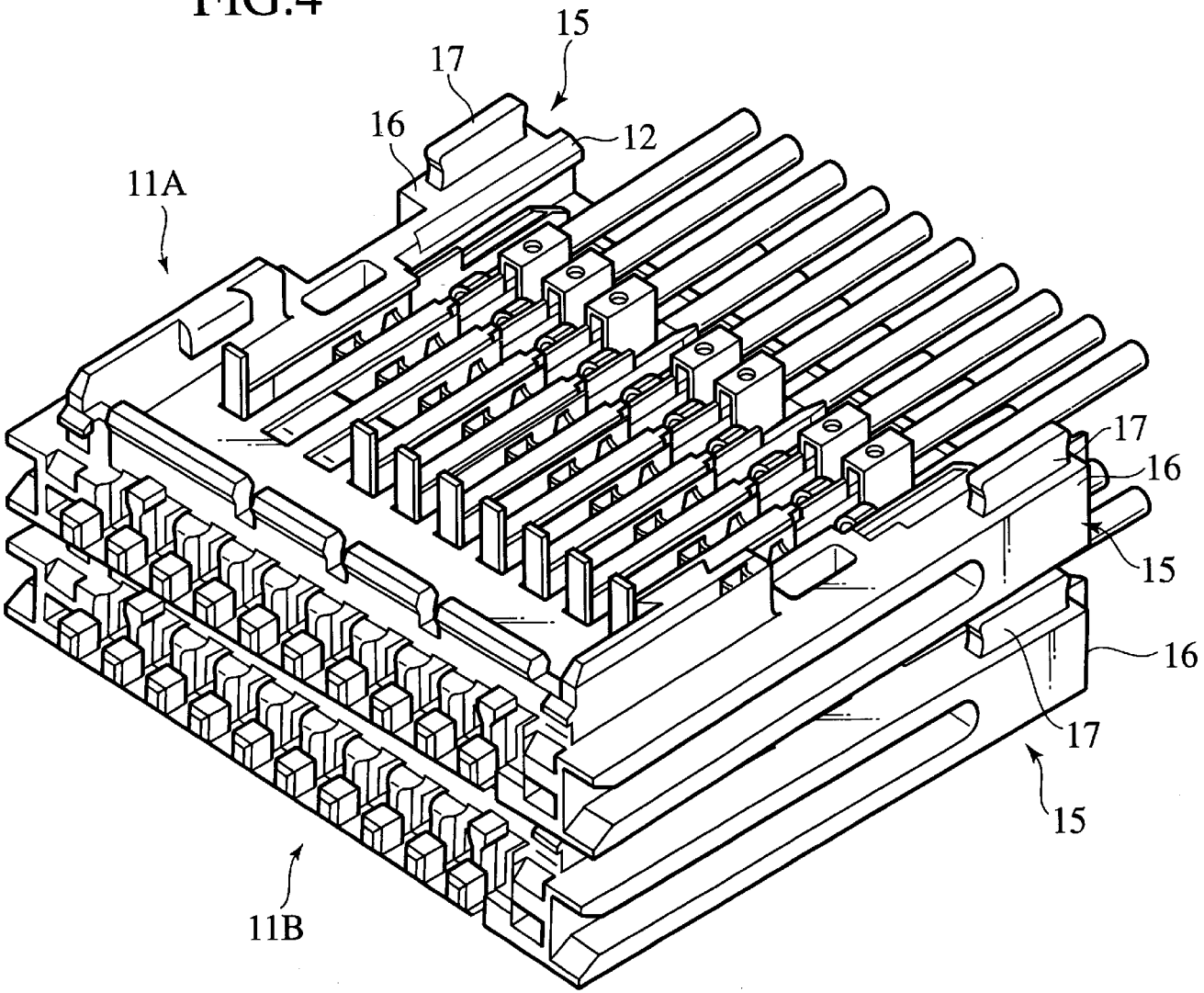
FIG. 4 is a perspective view where upper and lower connector housings are to be integrated for constitution of a connector assembly according to the invention.

In the above-described embodiment, though the protrusions 17 are provided at the upper faces of the box parts 16 and the recessed parts 18 are provided at the lower faces, they may be revered. As shown on FIG. 5, the protrusions 17 may be provided at the lower faces of the box parts 16 and the recessed parts 18 may be provided at the upper faces.

While preferred embodiments of the present invention have been described using specific terms, such description is for illustrative purposes, and it is to be understood that changes and variations may be made without departing from the spirit or scope of the following claims.

What is claimed is:

1. A connector assembly comprising:

a plurality of connector housings stacked vertically in multi-steps, each of the connector housings comprising a first lock claw and a second lock claw, the first lock claw including a flexure-deformable mounting part, the first lock claw of one of the connector housings being configured to engage with the second lock claw of another connector housing by flexure deformation of the mounting part for integration of the connector housings, and the mounting part having a protrusion and a recessed part thereof;

wherein the protrusion in the mounting part of one of the connector housings is fitted with the recessed part in the mounting part of another connector housing so as to restrict flexure deformation of the mounting part after the connector housings are integrated.

2. A connector assembly according to claim 1, wherein the lock claw is provided at both of side parts thereof.

3. A connector assembly according to claim 1, wherein the first lock claw is positioned at an upper face of the connector assembly and the second lock claw is positioned at a lower face of the connector assembly.

4. A connector assembly according to claim 1, wherein the protrusion is provided at an upper face of the mounting part and the recessed part is provided at a lower face of the mounting part.

5. A connector assembly according to claim 1, wherein the protrusion is provided at a lower face of the mounting part and the recessed part is provided at an upper face of the mounting part.

* * * * *

UNITED STATES PATENT AND TRADEMARK OFFICE

CERTIFICATE OF CORRECTION

PATENT NO. : 6,343,959 B2
DATED : February 5, 2002
INVENTOR(S) : Kei Sato

It is certified that error appears in the above-identified patent and that said Letters Patent is hereby corrected as shown below:

Column 4,
Line 18, “multi-steps,” should read -- multi-steps; --.

Signed and Sealed this

Thirtieth Day of July, 2002

*Attest:*

*Attesting Officer*

JAMES E. ROGAN
*Director of the United States Patent and Trademark Office*